US007794568B2

(12) United States Patent
Odmark

(10) Patent No.: US 7,794,568 B2
(45) Date of Patent: Sep. 14, 2010

(54) METHOD AND APPARATUS OF A TWIN-WIRE PRESS

(75) Inventor: Leif Odmark, Matfors (SE)

(73) Assignee: Metso Paper, Inc. (FI)

( * ) Notice: Subject to any disclaimer, the term of this patent is extended or adjusted under 35 U.S.C. 154(b) by 597 days.

(21) Appl. No.: 11/666,854

(22) PCT Filed: Oct. 19, 2005

(86) PCT No.: PCT/SE2005/001563

§ 371 (c)(1),
(2), (4) Date: May 2, 2007

(87) PCT Pub. No.: WO2006/049548

PCT Pub. Date: May 11, 2006

(65) Prior Publication Data

US 2008/0110589 A1 May 15, 2008

(30) Foreign Application Priority Data

Nov. 2, 2004 (SE) ..... 0402648

(51) Int. Cl.

| | |
|---|---|
| ***D21F 1/80*** | (2006.01) |
| ***D21F 3/06*** | (2006.01) |
| ***B30B 9/24*** | (2006.01) |
| ***B30B 5/06*** | (2006.01) |

(52) U.S. Cl. ..... 162/210; 162/203; 162/300; 162/301; 162/305; 100/37; 100/118

(58) Field of Classification Search ..... 162/203, 162/300, 301, 303, 304, 305, 272, 273, 55, 162/56, 60, 210; 100/37, 41, 118–120; 210/400, 210/401

See application file for complete search history.

(56) References Cited

U.S. PATENT DOCUMENTS

| | | | | |
|---|---|---|---|---|
| 2,881,676 | A * | 4/1959 | Thomas | 162/203 |
| 3,942,433 | A | 3/1976 | Wohlfarter | |
| 4,681,033 | A | 7/1987 | Crandall et al. | |
| 5,185,064 | A | 2/1993 | Nyman | |
| 5,545,333 | A * | 8/1996 | Louden et al. | 210/739 |
| 5,783,045 | A | 7/1998 | Santos et al. | |
| 6,197,160 | B1 * | 3/2001 | Sbaschnigg et al. | 162/301 |

FOREIGN PATENT DOCUMENTS

| | | |
|---|---|---|
| AT | 385 793 | 10/1987 |
| WO | WO-97/17192 | 5/1997 |
| WO | WO-02/10509 A1 | 2/2002 |

* cited by examiner

*Primary Examiner*—Eric Hug
(74) *Attorney, Agent, or Firm*—Lerner, David, Littenberg, Krumholz & Mentlik, LLP

(57) ABSTRACT

Methods for dewatering a fiber suspension in a twin-wire press, having a lower wire and an upper wire, and a first and a second dewatering table, which supports the wires such that a dewatering space is defined by the wires, are disclosed. The wires transport the fiber suspension under compression of the wires by the dewatering tables, such that the fiber suspension is dewatered and forms a fiber web between the wires. A separate pressing force is applied against one of the wires, such that this wire presses the formed fiber web via the second wire against one of the dewatering tables and further dewaters the fiber web. The separate pressing force is adjusted such that a desired dryness of the fiber web leaving the dewatering tables is achieved. A twin-wire press is also disclosed.

13 Claims, 2 Drawing Sheets

METHOD AND APPARATUS OF A TWIN-WIRE PRESS

FIELD OF THE INVENTION

The present invention relates to a method and a twin-wire press, for dewatering of a fiber suspension.

BACKGROUND OF THE INVENTION

Twin-wire presses for dewatering of a fiber suspension and forming of a continuous web thereof are previously known. Dewatering of the pulp is usually done from an inlet pulp concentration of from 3 to 8 percent by weight to an outlet pulp concentration of from 30 to 50 percent by weight. According to the state of the art, such twin-wire presses comprises lower rolls, an endless lower wire running in a path around the lower rolls, upper rolls, and an endless upper wire running in a path around the upper rolls. The two wires co-operate with each other along sections of said paths that run substantially in parallel with each other for dewatering of the fiber suspension between the wires during displacement thereof. An inlet box provides for supply of the fiber suspension to a wedge-shaped dewatering space between the wires. The twin-wire press further comprises two dewatering tables supporting the respective wires in said sections of the path and forming the wedge-shaped dewatering space between the wires for initially pressing and dewatering the fiber suspension, whereby a web is formed between the wires, and a roll arrangement situated after the dewatering tables in said sections of the paths, as seen in the direction of movement of the wires, for finally pressing and dewatering the web between the wires, so that the web will obtain a desired dryness. By dewatering space is meant the part of the dewatering tables where dewatering occurs.

A conventional dewatering space in a twin-wire press has a wedge-shape with a fixed shape that is not changeable when the twin-wire press is in operation. The geometry of the table and the flow of the pulp suspension creates the operating pressure difference over the wire that controls the dewatering. The wedge-shape determines the built up pressure in the twin-wire press and the dewatering procedure is to a large extent dependent on the shape of the wedge, which is difficult to change. Alteration of the wedge-shape requires new, extensive settings of the dewatering tables, exchange of side sealings to the dewatering tables, etc.

The dewatering tables in a twin-wire press is the first step in the dewatering of a fiber suspension and is adapted for relatively slow dewatering and also for preparation of the formed fiber web, formed through dewatering of the fiber suspension, for the much faster dewatering that occurs in the subsequent roll arrangement through pressing in a roll nip. Too large a loading of the dewatering tables directly results in high frictional forces and also very high energy consumption for the operation. The step between the relatively slow dewatering in the dewatering tables and the very fast dewatering in the roll arrangement is considerable and may sometimes give rise to problems in the first roll nip in the roll arrangement. In case the fiber web has far too low a pulp concentration when it leaves the dewatering tables, and is received and deformed with far too high a speed in the first roll nip in the roll arrangement, the fiber web may be destroyed.

One object of the present invention is to at least partially eliminate those drawbacks associated with the previously known state of the art of twin-wire presses that have been described above. A further object of the present invention is to achieve easier and more improved dewatering by the dewatering tables in a twin-wire press without changing the geometry of the dewatering tables. An additional object of the present invention is to overcome the considerable difference of conventional twin-wire presses between the relatively slow speed at which the fiber suspension/web is deformed and the relatively high speed the fiber web is deformed by the roll arrangement.

SUMMARY OF THE INVENTION

These and other objects are achieved with the method for dewatering a fiber suspension in a twin-wire press according to the present invention. The twin-wire press has an endless lower wire and an endless upper wire, and first and a second dewatering tables, which support the wires such that an oblong wedge-shaped dewatering space is defined by the wires. According to the method of the present invention, the wires transport the fiber suspension under the compression of the wires past the dewatering tables, such that the fiber suspension is dewatered and forms a fiber web between the wires. The method is characterised in that a separate pressing force is applied against one of the wires, such that this wire presses the formed fiber web via the second wire against one of the dewatering tables and further dewaters the fiber web. The separate pressing force is adjusted such that a desired dryness of the fiber web leaving the dewatering tables is achieved.

The frictional loads can be decreased to half during the additional dewatering of the fiber web through use of the separate pressing force, which does not cause any frictional force, against one of the wires in accordance with the method of the present invention, compared to a conventional twin-wire press where upper and lower dewatering tables give rise to frictional forces. Application of a separate pressing force during the additional dewatering results in a particularly effective pressing for dewatering that is adjusted independent of the load on the fiber web achieved by the dewatering tables in the wedge-shaped dewatering space. The separate pressing force, respectively the compression of the wires for dewatering of the fiber suspension that is accomplished along the whole wedge-shaped dewatering space by the dewatering tables, acts individually, and separately, and thus does not influence each other.

According to a preferred embodiment of the present invention, the first dewatering table is an upper dewatering table and the second dewatering table is a lower dewatering table. Moving at least one of the dewatering tables, suitably the upper dewatering table, in a vertical direction, controls the compression of the wires by the dewatering tables. The separate pressing force is preferably applied at an end of the dewatering tables that is situated in connection with a subsequent roll arrangement of the twin-wire press.

The present invention also relates to a twin-wire press for dewatering of a fiber suspension, having an endless lower wire and an endless upper wire. A first and a second dewatering table supports the respective wires, such that an oblong dewatering space is defined by the wires. Further, the twin-wire press comprises an inlet box for supply of fiber suspension to the dewatering space, in which the fiber suspension is dewatered under transportation of the wires and compression between the dewatering tables, whereby the dewatered suspension forms a fiber web between the wires. A pressing apparatus is arranged to apply a separate pressing force against one of the wires, such that this wire presses the formed fiber web via the second wire against one of the dewatering tables and further dewaters the fiber web. The pressing apparatus is arranged to adjust the separate pressing force such that a desired dryness of the fiber web leaving the dewatering tables is achieved.

In a preferred embodiment of the present invention, the pressing apparatus is a press roll, preferably a hole roll or a grooved roll. The press roll can be a solid roll or a roll with an envelope surface and an inner cavity. By the term hole roll is meant a roll which envelope surface is perforated. The holes in the envelope surface can be substantially circular but they may also have another shape. The shape of the grooves or slots is chosen such that a favorable dewatering is achieved. Preferably the twin-wire press comprises at least a perforated dewatering element that is arranged against the second wire outside the dewatering space. Owing to the fact that the surface also comprises grooves or slots, increased dewatering efficiency of the fiber web is achieved by application of the separate pressing force.

Additional preferred embodiments according to the present invention are evident from the following by the detailed description with reference to the accompanying drawings.

BRIEF DESCRIPTION OF THE DRAWINGS

The present invention will now be described in more detail in the following detailed description, which in turn refers to the accompanying drawings, without restricted interpretation of the invention thereof, in which.

DETAILED DESCRIPTION

Figure 1:
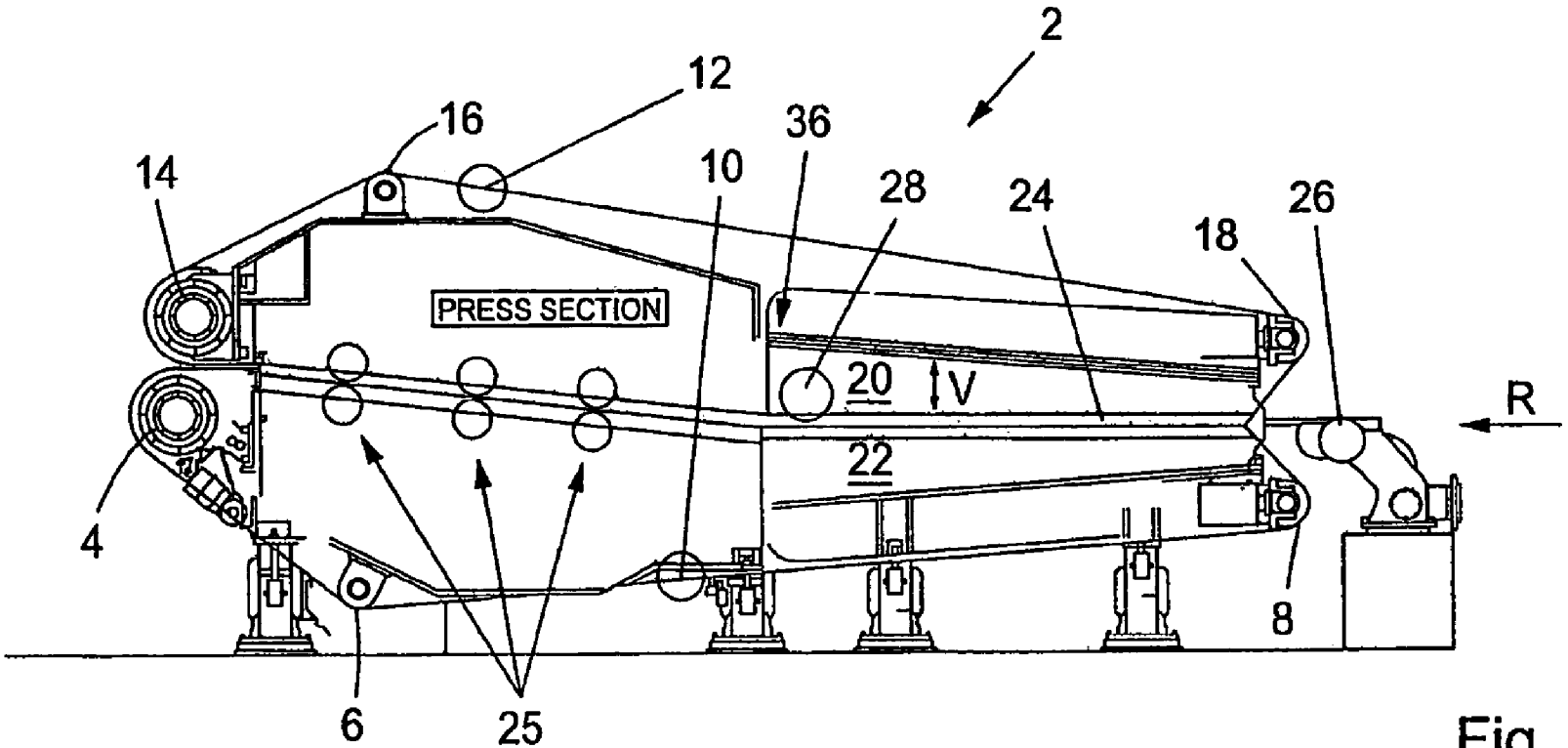
FIG. 1 is a top, schematic, cross-sectional view of a twin-wire press according to the present invention.

Referring to the Figures, in which like reference numerals refer to like elements thereof, FIG. 1 shows a twin-wire press 2 according to the present invention and which is suitable for carrying out the method according to the present invention. The twin-wire press 2 comprises three lower rolls, namely a drive roll 4, a control roll 6 and a tensioning roll 8. An endless lower wire 10 runs in a path around the lower rolls 4, 6 and 8. In a corresponding manner an upper endless wire 12 runs in a path around three upper rolls, namely a drive roll 14, a control roll 16 and a tensioning roll 18. An upper dewatering table 20, that supports the upper wire 12, and a lower dewatering table 22, that supports the lower wire 10, forms the dewatering space 24 between the wires 10, 12 in which the fiber suspension/web is dewatered under movement of the wires and compression between the dewatering tables (in a direction R, from the right to the left in the drawings), whereby the dewatered suspension forms a fiber web between the wires. "Press section" refers to an ordinary roll arrangement according to the state of the art that can involve a plurality of roll pairs 25, such as schematically shown in FIG. 1. An inlet box 26 is arranged at one end of the press.

Figure 2:
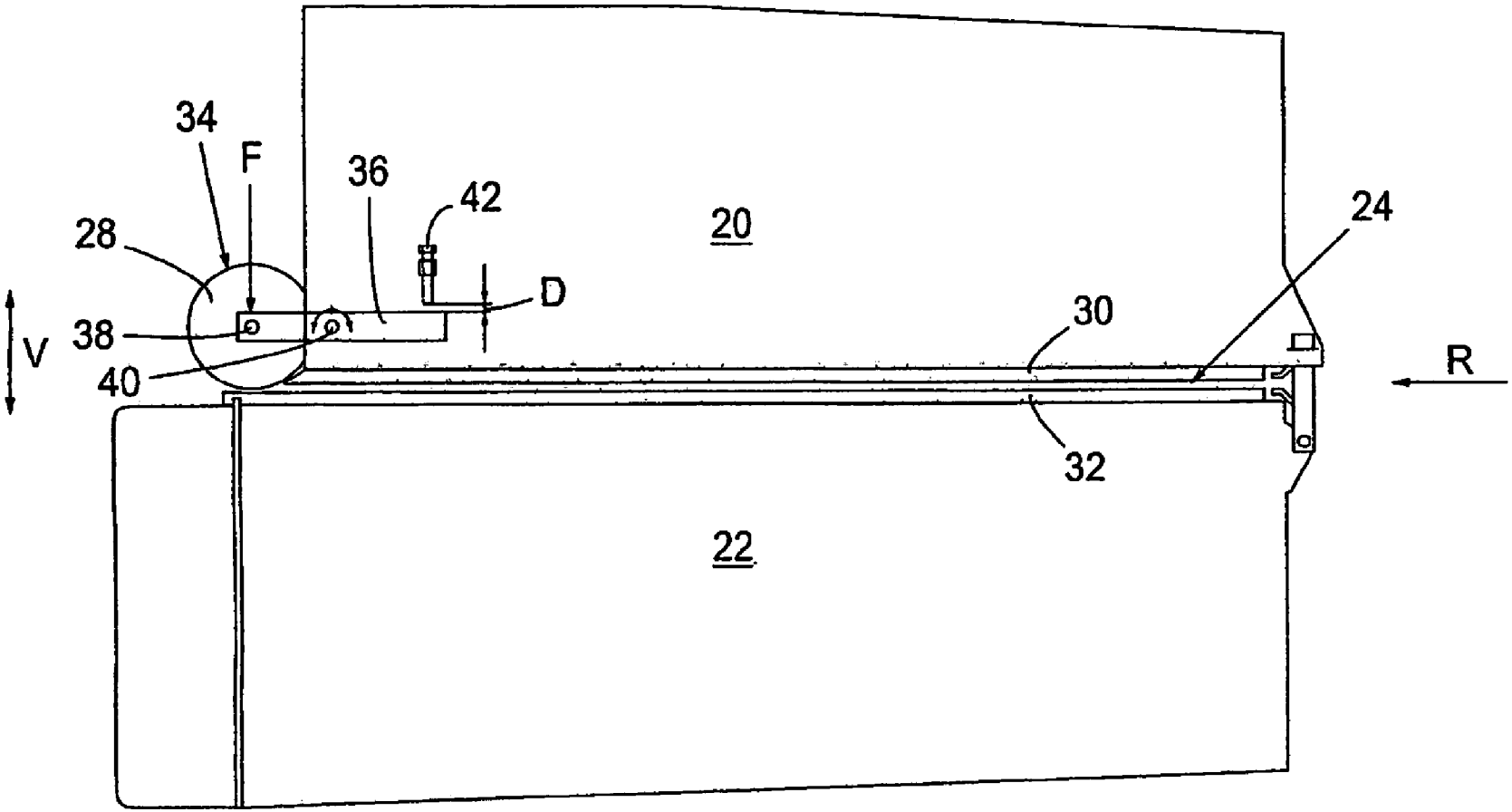
FIG. 2 is a partial, side, cross-sectional schematic view of a part of the dewatering table of the twin-wire press in FIG. 1 according to the present invention.

As is evident from FIGS. 1 and 2, a press roll 28 is arranged in connection with the dewatering space 24 at the upper dewatering table 20. The press roll 28 is arranged to apply a separate pressing force F on the upper wire 12 (not shown in FIG. 2), such that this wire presses the formed fiber web via the lower wire 10 (not shown in FIG. 2) against the lower dewatering table 22 and further dewaters the fiber web. The press roll 28 is arranged to adjust the separate pressing force F such that a desired dryness of the fiber web that leaves the dewatering tables, 20 and 22, is accomplished. The separate pressing force F is adjusted independently of the load on the fiber web achieved by the dewatering tables, 20 and 22.

As is evident in FIG. 2, the twin-wire press 2 can further comprise perforated upper and lower dewatering elements, 30 and 32, respectively, that are arranged against the wires, 10 and 12 (see FIG. 1; not shown in FIG. 2) outside the dewatering space 24. The twin-wire press suitably comprises a lower outlet box (not shown) for catching the filtrate that flows from the dewatering space 24 through the lower wire 10 and the lower perforated dewatering element 32, and an upper outlet box (not shown) for catching filtrate that flows from the dewatering space through the upper wire 12 and the upper perforated dewatering element 30.

As is evident from the embodiment according to FIG. 2, the press roll 28 can be arranged to one of the dewatering tables by means of an arm 36, attached to a first outer end to the center 38 of the press roll. The arm 36 is pivotally journalled in bearings about an axis of rotation 40 arranged with respect to the dewatering table, in this case the upper dewatering table 20. A control device 42, such as a screw-like member, is arranged with adjustable distance D in attached connection to a second outer end of the arm 40 at the dewatering table 20. The control device 42 is arranged to adjust how far down it is possible to press the press roll 28 against the dewatering space 24 and the lower dewatering table 22. Thus, the control device 42 limits the movement of the press roll in the direction against the dewatering space 24, such that it will always be a certain distance between the wires, 10 and 12. The object of the control device 42 is to prevent the press roll 28 from loading the lower dewatering table when there does not exist any fiber suspension/web between the wires, which would otherwise result in damage to the wires, and also to not completely close the space between the wires. For example, at too low an inlet concentration of the fiber web, it can otherwise be broken off completely.

The twin-wire press 2, in accordance with the present invention, can be shaped such that the upper dewatering table 20 is arranged for movement in the vertical direction V (see FIG. 1) relative to the lower dewatering table 22, and the lower dewatering table can be fixed.

According to an embodiment of the present invention, the press roll 28 can be a hole roll or a grooved roll. By means of sharpening the surface 34 of the roll with holes, grooves or slots, increased dewatering efficiency of the fiber web can be achieved by application of the separate pressing force F, since the recesses facilitates the carrying away of the filtrate.

During operation of the twin-wire press 2, by the method according to the present invention, the following occurs:

According to the method the wires, 10 and 12, move the fiber suspension under the compression of the wires by the dewatering tables, 20 and 22, such that the fiber suspension is dewatered and forms a fiber web between the wires. A separate pressing force F is applied by the press roll 28 against the upper wire 12, such that this wire 12 presses the formed fiber web via the lower wire 10 against the lower dewatering table 22 and further dewaters the fiber web. The separate pressing force F is adjusted such that a desired dryness of the fiber web that leaves the dewatering tables, 20 and 22, is achieved. According to a preferred embodiment, the flow of filtrate from the dewatering is conveyed, by means of the applied separate pressing force F, to flow by means of perforated dewatering elements, 30 and 32, that are arranged outside the dewatering space 24 of at least the lower dewatering table 22. The filtrate that flows from the dewatering space 24 through the wires is collected in outlet boxes (not shown).

The compression of the dewatering tables, 20 and 22, by the wires, 10 and 12, can be controlled by movement in the vertical direction V of at least one of the dewatering tables, 20 and 22. The separate pressing force F is suitably applied at an end 36 of the dewatering tables, 20 and 22, that is situated in connection with a subsequent roll arrangement "press section" of the twin-wire press 2. It is possible, within the scope of the inventive concept according to the present invention, that the twin-wire press comprises more than one press apparatus/roll 28, such as mentioned above, for application of the separate pressing force F. In such a case those press apparatuses/rolls are arranged in the vicinity of the above mentioned end 36 of the dewatering tables, 20 and 22.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A method for dewatering a fiber suspension in a twin-wire press, having an endless lower wire and an endless upper wire, and a first and a second dewatering table, which supports the respective wires such that an oblong dewatering space is defined by the wires between the wires, by which method the wires transport the fiber suspension under the compression of the wires by the dewatering tables in a predetermined direction, such that the fiber suspension is dewatered and forms a fiber web between the wires, the method comprising:

applying a separate pressing force against one of said wires at an end of said dewatering tables located downstream in said predetermined direction including a subsequent roll arrangement of said twin wire press, so that said one of said wires presses the formed fiber web via the second wire against one of the dewatering tables and further dewaters the fiber web independently of the load on the fiber web achieved by the dewatering tables, and adjusting the separate pressing force so that a desired dryness of the fiber web leaving the dewatering tables is achieved.

2. The method according to claim 1, wherein the first dewatering table is an upper dewatering table and the second dewatering table is a lower dewatering table, and the compression of the wires by the dewatering tables is controlled by moving at least one of the dewatering tables in a vertical direction.

3. The method according to claim 1, wherein a flow of water in the form of filtrate from the dewatering by application of the separate pressing force flows via perforated dewatering elements that at least are arranged outside the dewatering space of the second dewatering table.

4. A twin-wire press for dewatering a fiber suspension, comprising an endless lower wire and an endless upper wire, a first dewatering table and a second dewatering table, which supports the respective wires such that an oblong dewatering space is defined by the wires between the wires, an inlet box for supply, of fiber suspension to the dewatering space, in which the fiber suspension is dewatered under transportation of the wires in a predetermined direction and compression between the dewatering tables, to form a fiber web of the dewatered suspension between the wires, and a pressing apparatus arranged to apply a separate pressing force against one of said wires at an end of said dewatering tables located downstream in said predetermined direction including a subsequent roll arrangement of said twin wire press, such that said one of said wires presses the formed fiber web via the second wire against one of the dewatering tables and further dewaters the fiber web independently of the load on the fiber web achieved by the dewatering table, wherein the pressing apparatus is arranged to adjust the separate pressing force such that a desired dryness of the fiber web leaving the dewatering tables is achieved.

5. A twin-wire press according to claim 4, wherein the twin-wire press comprises upper and lower perforated dewatering elements that are arranged against the wires outside the dewatering space.

6. A twin-wire press according to claim 4, wherein said first dewatering table is an upper dewatering table and that said second dewatering table is a lower dewatering table.

7. A twin-wire press according to claim 6, wherein said upper dewatering table is arranged for movement in a vertical direction relative to the lower dewatering table and the lower dewatering table is fixed.

8. A twin-wire press according to claim 4, wherein the pressing apparatus is a press roll.

9. A twin-wire press according to claim 8, wherein the press roll comprises a hole roll or a grooved roll.

10. A method for dewatering a fiber suspension in a twin-wire press, having an endless lower wire and an endless upper wire, and a first and a second dewatering table, which supports the respective wires such that an oblong dewatering space is defined by the wires between the wires, by which method the wires transport the fiber suspension under the compression of the wires by the dewatering tables, such that the fiber suspension is dewatered and forms a fiber web between the wires, the method comprising:

applying a separate pressing force against one of said wires, so that said one of said wires presses the formed fiber web via the second wire against one of the dewatering tables and further dewaters the fiber web independently of the load on the fiber web achieved by the dewatering tables thereby creating a flow of water in the form of filtrate from said dewatering by application of said separate pressing force flows through perforated dewatering elements that are at least arranged outside the dewatering space of the second dewatering table, and adjusting the separate pressing force so that a desired dryness of the fiber web leaving the dewatering tables is achieved.

11. A twin-wire press for dewatering a fiber suspension, comprising an endless lower wire and an endless upper wire, a first dewatering table and a second dewatering table, which supports the respective wires such that an oblong dewatering space is defined by the wires between the wires, upper and lower perforated dewatering elements arranged against the wires outside said dewatering space, an inlet box for supply of fiber suspension to the dewatering space, in which the fiber suspension is dewatered under transportation of the wires and compression between the dewatering tables, to form a fiber web of the dewatered suspension between the wires, and a pressing apparatus arranged to apply a separate pressing force against one of said wires, such that said one of said wires presses the formed fiber web via the second wire against one of the dewatering tables and further dewaters the fiber web independently of the load on the fiber web achieved by the dewatering table, wherein the pressing apparatus is arranged to adjust the separate pressing force such that a desired dryness of the fiber web leaving the dewatering tables is achieved.

12. A twin-wire press for dewatering a fiber suspension, comprising an endless lower wire and an endless upper wire, a first dewatering table and a second dewatering table, which supports the respective wires such that an oblong dewatering space is defined by the wires between the wires, an inlet box for supply of fiber suspension to the dewatering space, in which the fiber suspension is dewatered under transportation of the wires and compression between the dewatering tables, to form a fiber web of the dewatered suspension between the wires, and a pressing apparatus comprising a press roll arranged to apply a separate pressing force against one of said wires, such that said one of said wires presses the formed fiber web via the second wire against one of the dewatering tables and further dewaters the fiber web independently of the load on the fiber web achieved by the dewatering table, wherein the pressing apparatus is arranged to adjust the separate pressing force such that a desired dryness of the fiber web leaving the dewatering tables is achieved.

13. A twin wire press according to claim 12 wherein the press roll comprises a hole roll or a grooved roll.

* * * * *